US008430368B2

(12) United States Patent
Hsu et al.

(10) Patent No.: US 8,430,368 B2
(45) Date of Patent: Apr. 30, 2013

(54) WALL MOUNTING BATH ACCESSORY ASSEMBLY

(75) Inventors: Weimien Hsu, Taichung (TW); Fenyong Nan, ShenZen (CN); Chunhung Li, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 269 days.

(21) Appl. No.: 12/946,477

(22) Filed: Nov. 15, 2010

(65) Prior Publication Data

US 2012/0119046 A1 May 17, 2012

(51) Int. Cl.
*A47K 5/00* (2006.01)
*A47K 1/00* (2006.01)
*E04G 5/06* (2006.01)

(52) U.S. Cl.
USPC ..... 248/222.12; 248/201; 248/220.21; 248/222.11

(58) Field of Classification Search ..... 248/222.11, 248/222.12, 225.12, 220.21, 475.1, 201, 248/223.41
See application file for complete search history.

(56) References Cited

U.S. PATENT DOCUMENTS

| | | | | | |
|---|---|---|---|---|---|
| 3,928,894 | A * | 12/1975 | Bury et al. | ..... | 248/467 |
| 4,668,059 | A * | 5/1987 | Ohyama | ..... | 248/549 |
| 4,917,244 | A * | 4/1990 | Sayers | ..... | 206/387.1 |
| 5,119,766 | A * | 6/1992 | Hostetler | ..... | 119/72.5 |
| 5,377,948 | A * | 1/1995 | Suman et al. | ..... | 248/549 |
| 5,931,440 | A * | 8/1999 | Miller | ..... | 248/549 |
| 7,690,607 | B2 * | 4/2010 | Garmyn | ..... | 248/201 |
| 7,717,394 | B2 * | 5/2010 | Tanaka et al. | ..... | 248/549 |

* cited by examiner

*Primary Examiner* — Amy J Sterling

(57) ABSTRACT

A wall mounting bath accessory assembly contains a fixing member including a contacting fence with a recess and two engaging portions, and the engaging portion including a shoulder arranged on an upper end thereof; a retaining member including a body, an first hook, and two second hooks; the first hooks being inserted through an upper end of the fixing member to retain with the recess so as to limit the retaining member; the second hook including a hooking segment to retain with the first hook and the recess, and when a lower end of the retaining member is pushed inward, the engaging portions of the fixing member abutting against the retaining member to cause a resilient deformation so that the retaining member retains with the engaging portions, and a top end of the anchor being stopped by the shoulder so that an upward displacement of the retaining member is limited.

14 Claims, 12 Drawing Sheets

WALL MOUNTING BATH ACCESSORY ASSEMBLY

BACKGROUND OF THE INVENTION

1. Field of the Invention

The present invention relates to a wall mounting bath accessory assembly to be fixed on a wall.

2. Description of the Prior Art

A conventional wall mounting bath accessory assembly is used in a rack to hold cloth, cap, towel and toilet papers, and includes a fixing member and a base. The fixing member is locked to a wall by using an anchor and a first bolt element, and includes a peripheral surface to be covered by a disc-shaped cover on the base, and a second bolt elements is inserted through the cover to retain the base to the fixing member, however, such the base disengages from the wall easily and is removed difficulty.

To overcome above-mentioned shortcomings, an improved wall mounting bath accessory assembly is disclosed in CN Pat. Nos. 201365798 and 2601614, and US Pub. No. US 20090108157 that include a retaining member to be locked to the base in advance so that the base is fixed by using the retaining member and the fixing member without applying any bolt elements.

However, the retaining member engages with the fixing member vertically, therefore when the bath accessory assembly moves, the base disengaged from the fixing member easily by using a common disassembling operation. Therefore, the base and the retaining member are removed easily that will be taken away if they are made of precious metal materials. To obtain a theft-proof purpose, a wall mounting bath accessory assembly has to be removed by using a specific but easy operation.

The present invention has arisen to mitigate and/or obviate the afore-described disadvantages.

SUMMARY OF THE INVENTION

The primary object of the present invention is to provide a wall mounting bath accessory assembly which is capable of overcoming the shortcomings of the conventional wall mounting bath accessory assembly.

Further object of the present invention is to provide a wall mounting bath accessory assembly that when the retaining member is touched to act accidentally, it is stopped to fall from the fixing member, obtaining a safe purpose.

Also a further object of the present invention is to provide a wall mounting bath accessory assembly that when disassembling the retaining member, the two second hooks of the retaining member are moved outward to disengage from the engaging portion of the fixing member, and then the second hooks are pushed upward so that the first hook disengages from the first chamber of the fixing member to remove the retaining member, the covering, and the shaft, thus preventing the bath accessory assembly from being removed easily, achieving a theft-proof purpose.

Another object of the present invention is to provide a wall mounting bath accessory assembly that the related components, such as the retaining member, the covering member, and the shaft, are assembled together without using any screw bolts, having a quick assembly and disassembly.

To obtain the above objectives, a wall mounting bath accessory assembly provided by the present invention contains a fixing member including a contacting fence disposed on an inner side thereof, the contacting fence including a recess fixed on an upper end thereof, the fixing member including two engaging portions extending from two sides of a lower end thereof respectively, and the engaging portion including a shoulder arranged on an upper end thereof;

a retaining member including a body, an inversely L-shaped first hook extending inward from a top end of the body, and two second hooks extending inward respectively from two sides of a lower end of the body; the first hooks being inserted through an upper end of the fixing member to retain with the recess so as to limit the retaining member; the second hook including a hooking segment formed on a distal end thereof to retain with the first hook and the recess, and when a lower end of the retaining member is pushed inward, the engaging portions of the fixing member abutting against the retaining member to cause a resilient deformation so that the retaining member retains with the engaging portions, and a top end of the anchor being stopped by the shoulder so that an upward displacement of the retaining member is limited.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
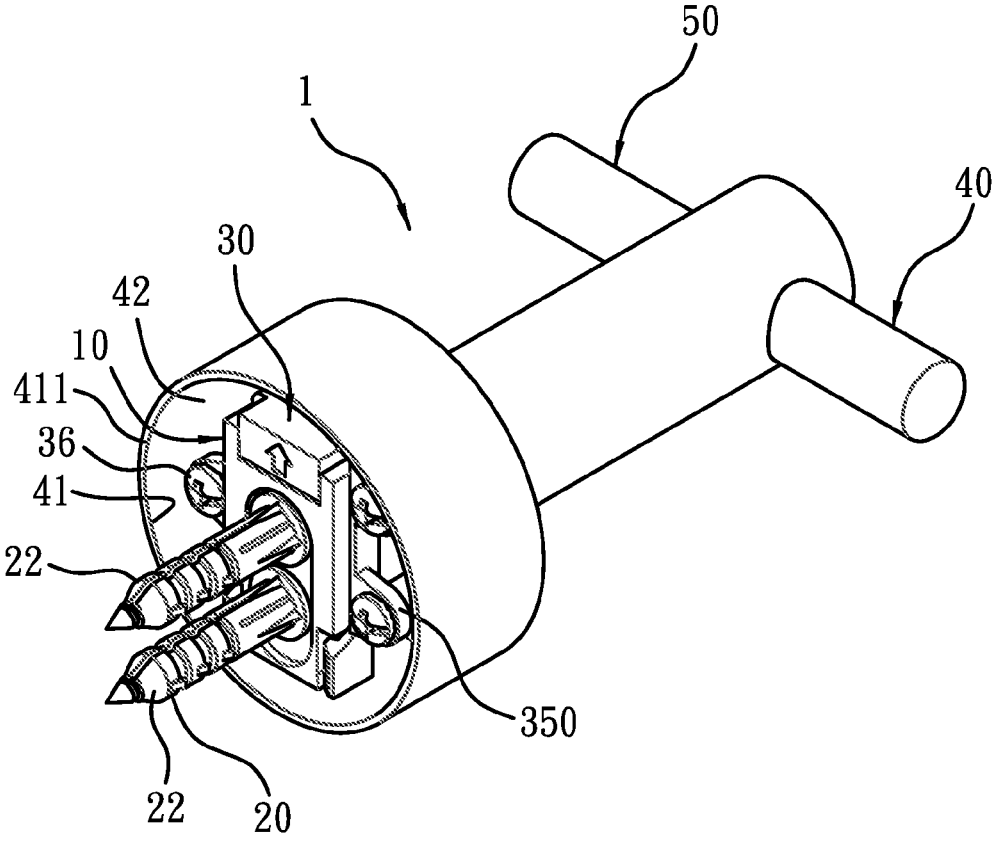
FIG. 1 is a perspective view showing the assembly of a wall mounting bath accessory assembly according to a first embodiment of the present invention.
Figure 2:
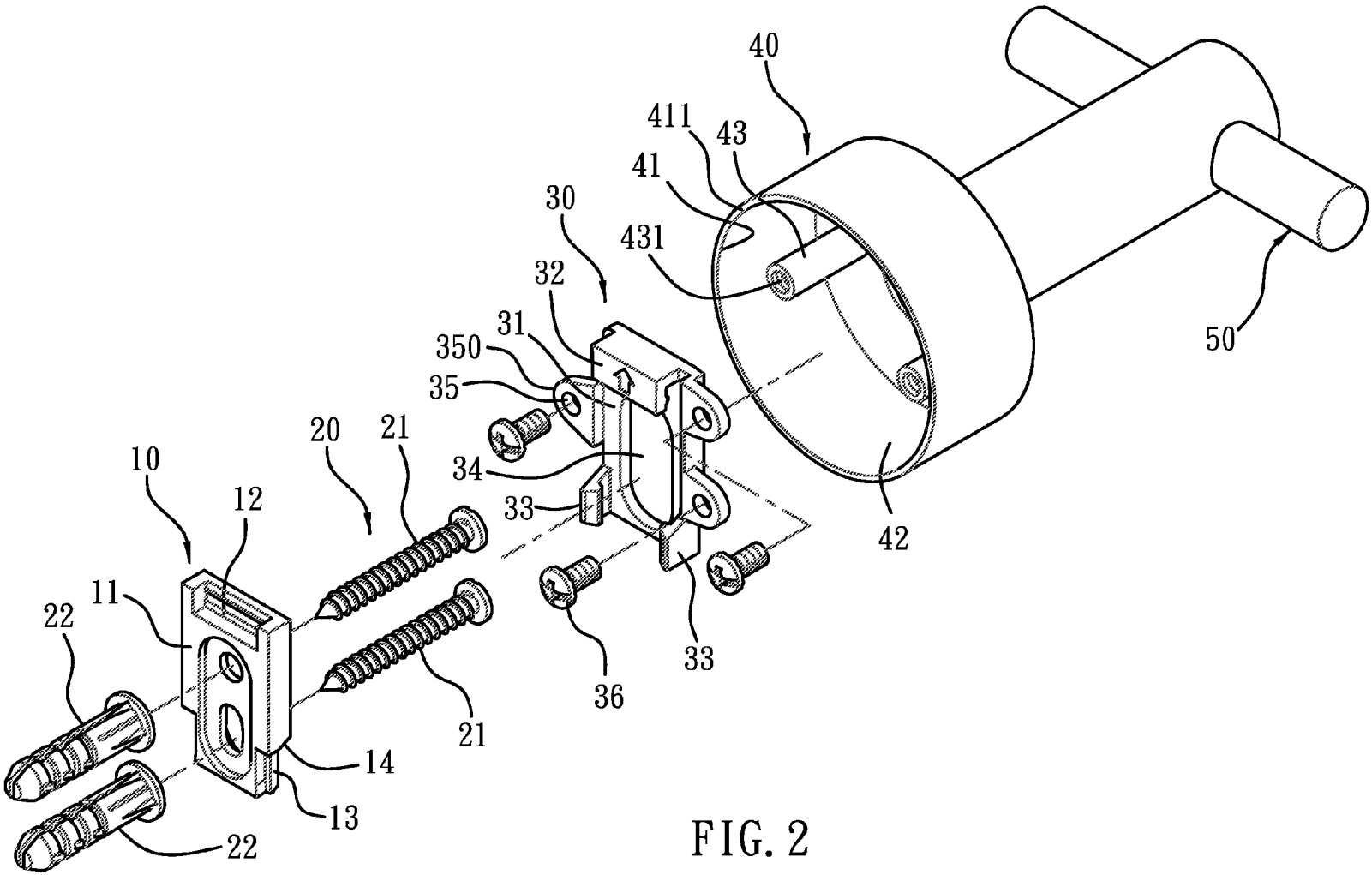
FIG. 2 is a perspective view showing the exploded components of the wall mounting bath accessory assembly according to the first embodiment of the present invention.

Referring to FIGS. 1 and 2, a wall mounting bath accessory assembly 1 according to a first embodiment of the present invention comprises a fixing member 10, a locking device 20, a retaining member 30, a covering member 40, and a shaft 50.

Figure 7A:
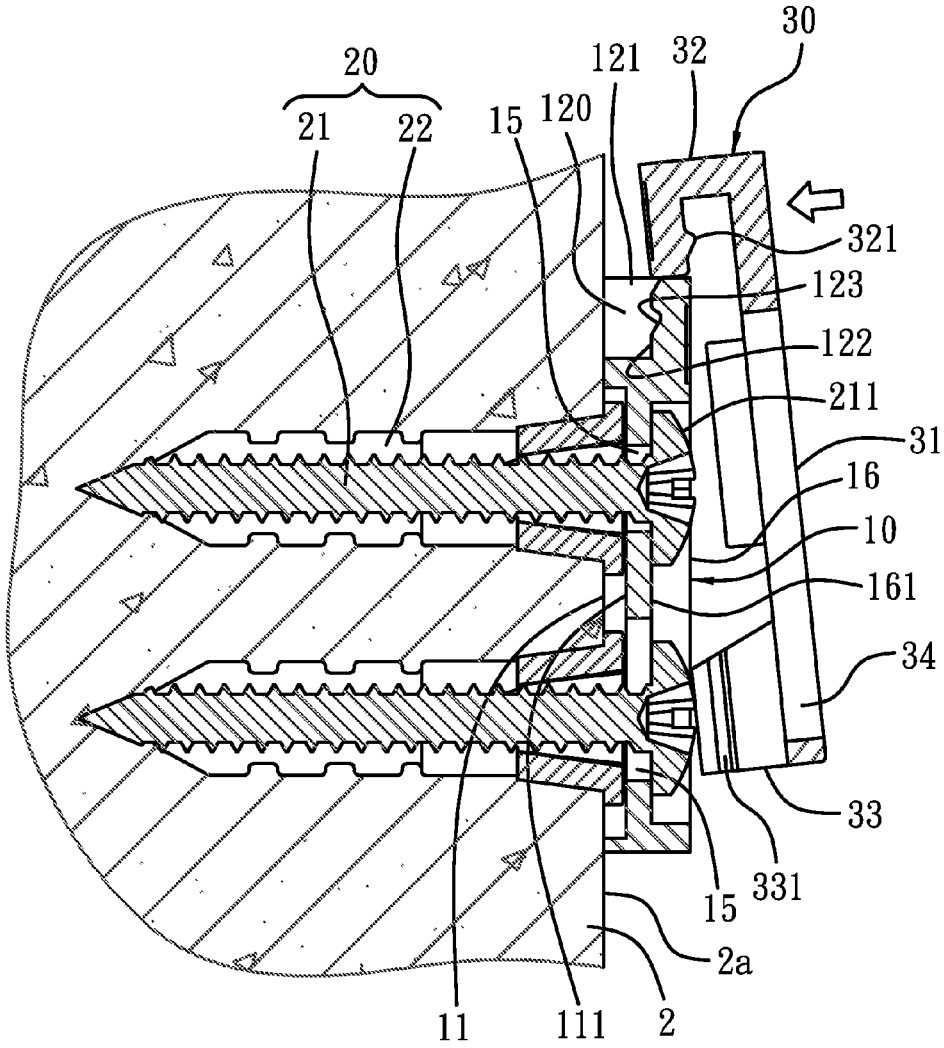
FIG. 7A is a cross sectional view showing the operation of the wall mounting bath accessory assembly in accordance with the first embodiment of the present invention.

The fixing member 10, as shown in FIGS. 3-6, includes a contacting fence 11 disposed on an inner side thereof to be fixed onto an outer face 2*a* of a wall 2 as illustrated in FIG. 7A; the contacting fence 11 includes a recess 12 fixed on an upper end thereof, and between the recess 12 and the outer face 2*a* of the wall 2 is defined a first chamber 120, the first chamber 120 includes an opening 121 formed on a top end thereof; the fixing member 10 includes two engaging portions 13 extending from two sides of a lower end thereof respectively, and the engaging portion 13 includes a shoulder 14 arranged on an upper end thereof, the shoulder 14 is a tilted surface extending from an outer side of the upper end of the engaging portion 13 to an inner side of the upper end of the engaging portion 13.

The recess 12 of the fixing member 10 includes an elongated positioning notch 123 extending thereon relative to a bottom cliff 122 of the outer face 2*a* of the wall 2.

The fixing member 10 includes two through holes 15 formed thereon; the two through holes 15 are arranged vertically on the fixing member 10 in this embodiment, wherein one through hole 15 is circular and formed on an upper side of the fixing member 10, and the other through hole 15 is elongated and extends vertically on a lower side of the fixing member 10, but the through hole 15 formed on the upper side of the fixing member 10 is capable of being formed in an elongated hole shape, and the other through hole 15 extending vertically on the lower side of the fixing member 10 allows to be formed in a circle shape.

The contacting fence 11 of the fixing member 10 includes a first cave 111 disposed thereon and formed in an oval shape to define the through holes 15, and further includes an external face 16 having a second cave 161 and formed in an oval shape to define the through holes 15.

Figure 8A:
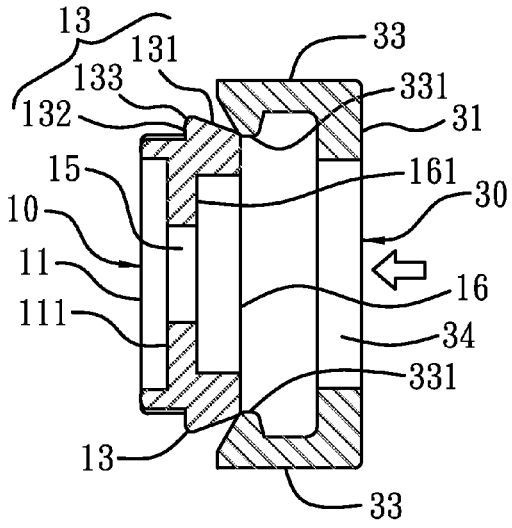
FIG. 8A is another cross sectional view showing the operation of the wall mounting bath accessory assembly in accordance with the first embodiment of the present invention.

The engaging portion 13 extends longitudinally on each of two sides of the lower end of the fixing member 10, and includes a side fringe 131, an internal fringe 132, and an arcuate engagement face 133 between the side fringe 131 and the internal fringe 132 as illustrated in FIG. 8A.

The locking device 20 is provided to position the fixing member 10 onto the outer face 2*a* of the wall 2, and includes two first screw bolts 21 and two anchors 22 retained in the wall 2. In operation, the first screw bolts 21 are inserted through the through holes 15 of the fixing member 10 to screw with the anchors 22 in the wall 2 so that the contacting fence 11 of the fixing member 10 engages with the outer face 2*a* of the wall 2 tightly.

It is to be noted that since the fixing member 10 is fixed by using the first screw bolts 21 and the anchors 22 in this embodiment. If desiring to prevent the contacting fence 11 from being stopped by a first head end 221 of the anchor 22 exposing outsides, the first cave 111 allows to be disposed on the contacting fence 11 of the fixing member 10 as shown in FIG. 9 and its size has to be more than that of the first head end 221 of the anchor 22.

Figure 3:
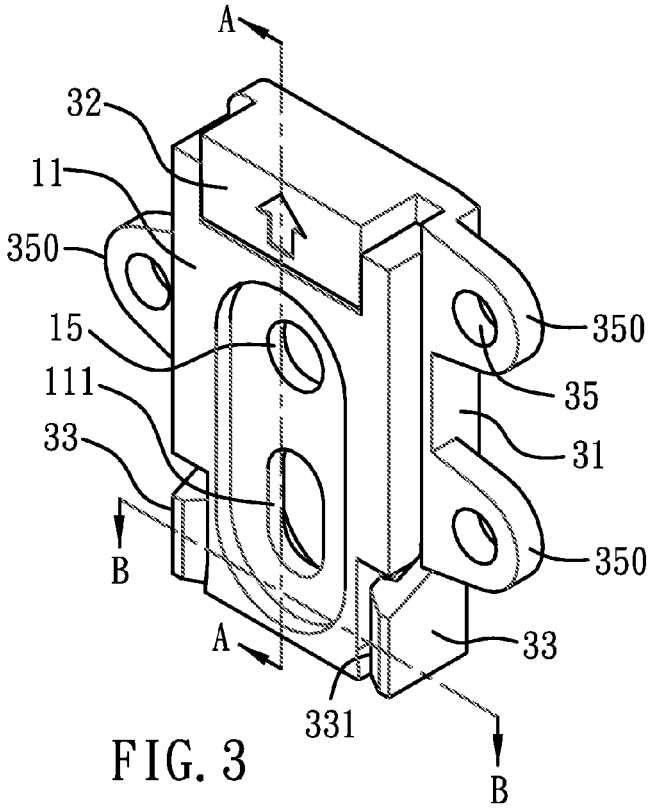
FIG. 3 is a perspective view showing the assembly of a fixing member and a retaining member of the wall mounting bath accessory assembly in accordance with the first embodiment of the present invention.
Figure 4:
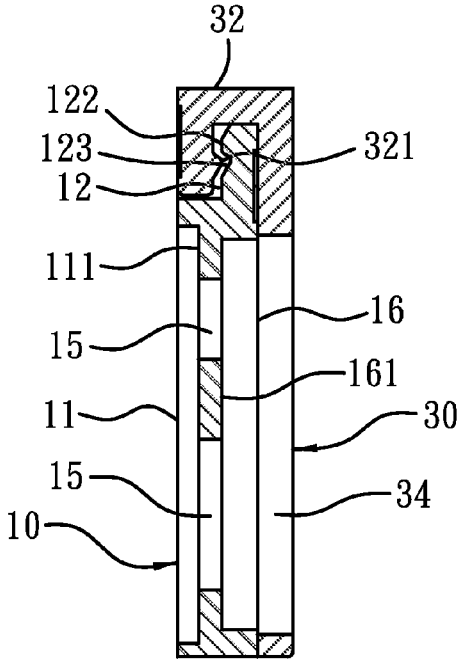
FIG. 4 is a cross sectional view taken the line A-A of FIG. 3.
Figure 5:
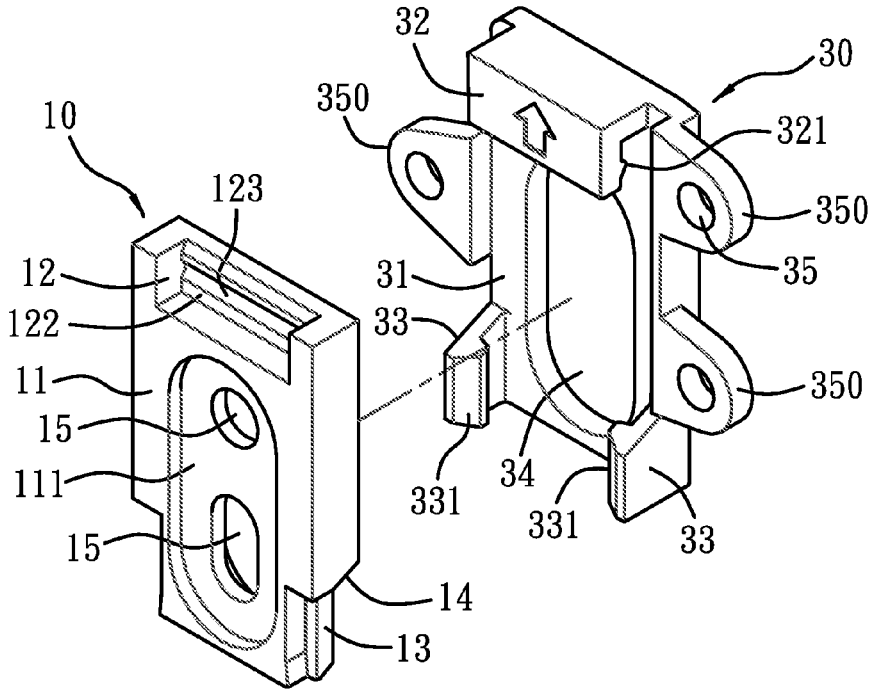
FIG. 5 is a perspective view showing the exploded components of the fixing member and the retaining member of the wall mounting bath accessory assembly in accordance with the first embodiment of the present invention.
Figure 6:
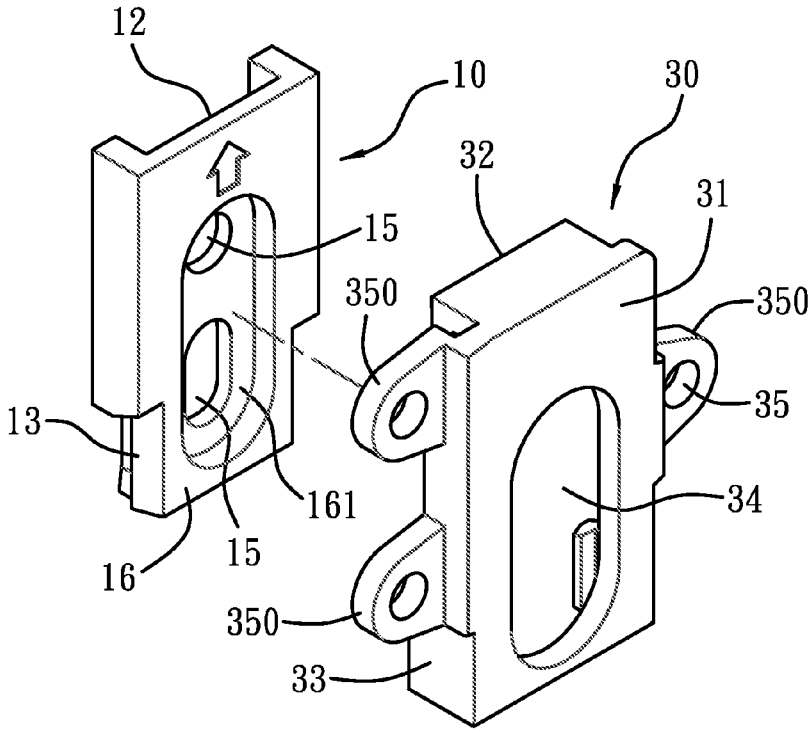
FIG. 6 is another perspective view showing the exploded components of the fixing member and the retaining member of the wall mounting bath accessory assembly in accordance with the first embodiment of the present invention.
Figure 8B:
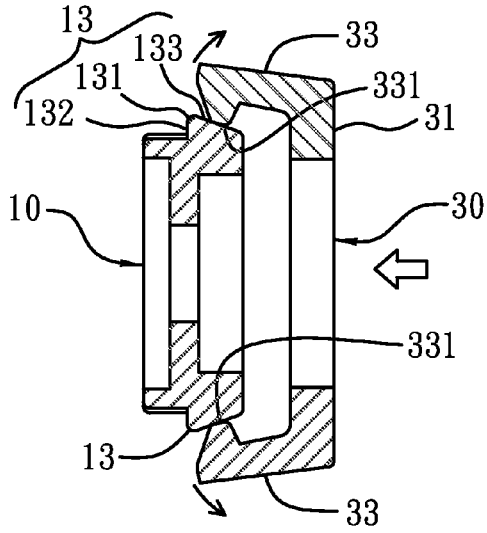
FIG. 8B is also another cross sectional view showing the operation of the wall mounting bath accessory assembly in accordance with the first embodiment of the present invention.
Figure 8C:
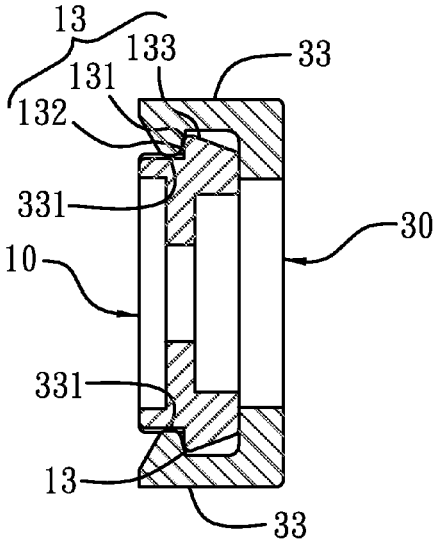
FIG. 8C is also another cross sectional view showing the operation of the wall mounting bath accessory assembly in accordance with the first embodiment of the present invention.
Figure 9:
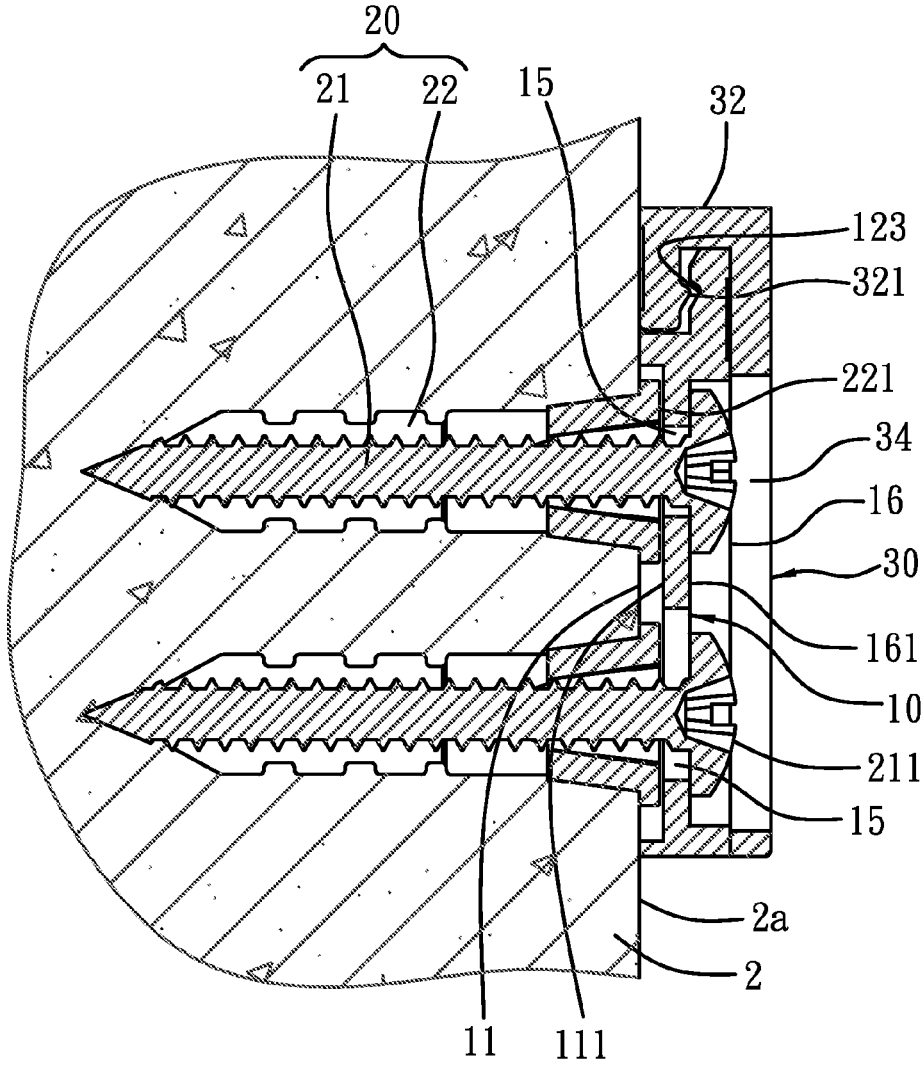
FIG. 9 is another cross sectional view showing the operation of the wall mounting bath accessory assembly in accordance with the first embodiment of the present invention.

The retaining member 30 includes a body 31, an inversely L-shaped first hook 32 extending inward from a top end of the body 31, and two second hooks 33 extending inward respectively from two sides of a lower end of the body 31; the first hooks 32 are inserted into the first chamber 120 through the opening 121 of the fixing member 10 so as to limit the retaining member 30 as shown in FIG. 9; the second hook 33 includes a hooking segment 331 formed on a distal end thereof to retain with the first hook 32 and the first chamber 120, and when a lower end of the retaining member 30 is pushed inward, the engaging portions 13 of the fixing member 10 abut against the retaining member 30 to cause a resilient deformation so that the retaining member 30 retains with the engaging portions 13 as illustrated in FIGS. 3 and 8C, and a top end of the anchor 22 is stopped by the shoulder 14 so that an upward displacement of the retaining member 30 is limited.

Figure 11:
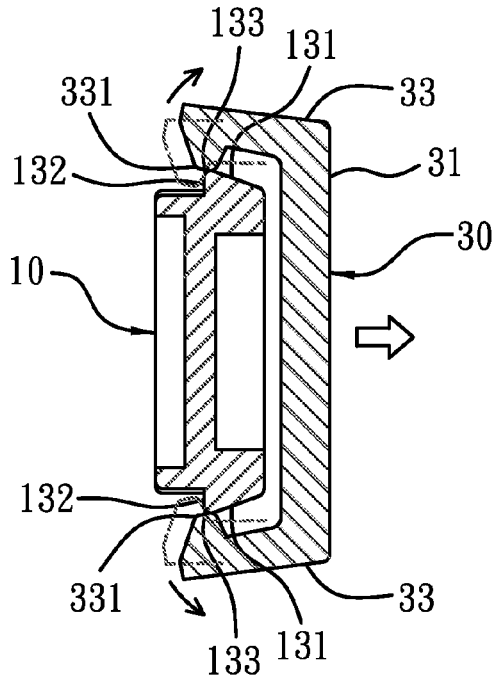
FIG. 11 is also another cross sectional view showing the operation of the wall mounting bath accessory assembly in accordance with the first embodiment of the present invention.
Figure 12:
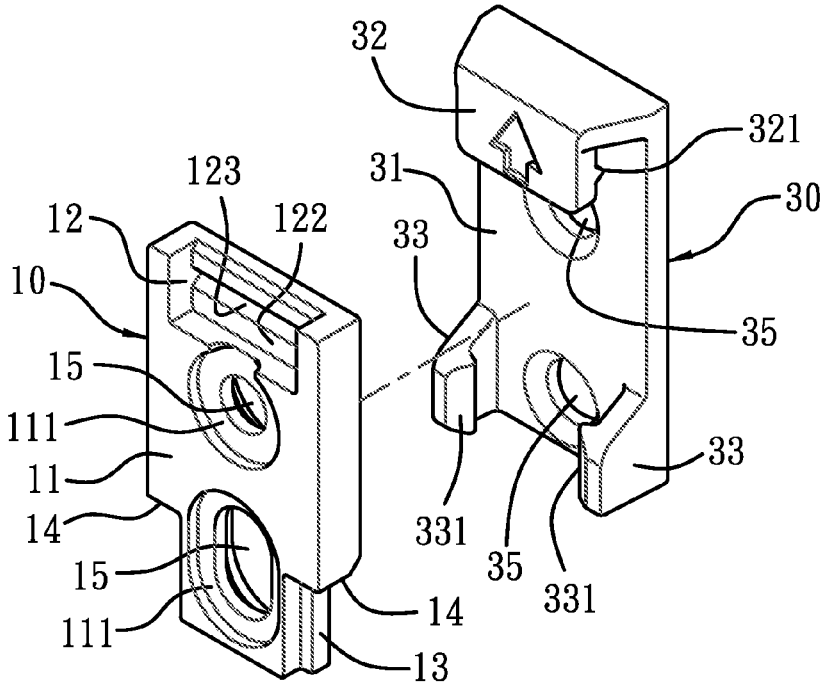
FIG. 12 is a perspective view showing the exploded components of a fixing member and a retaining member of a wall mounting bath accessory assembly in accordance with a second embodiment of the present invention.
Figure 13:
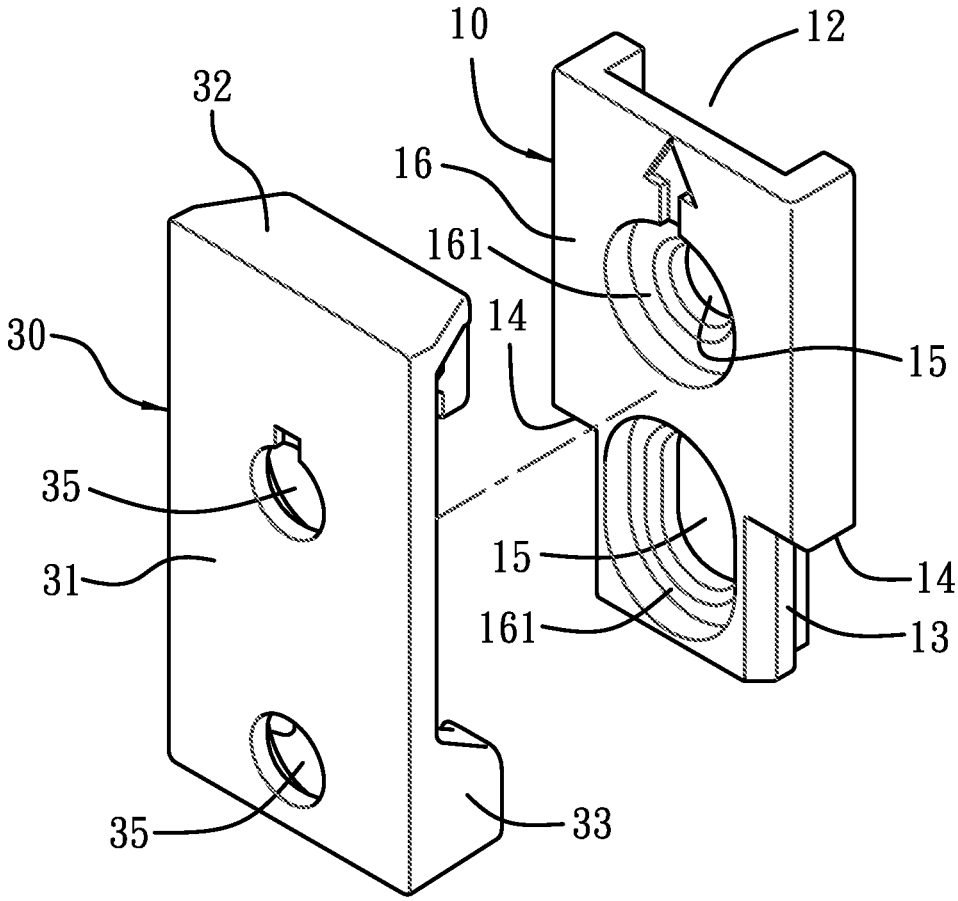
FIG. 13 is another perspective view showing the exploded components of the fixing member and the retaining member of the wall mounting bath accessory assembly in accordance with the second embodiment of the present invention.

The hooking segment 331 of the second hook 33 of the retaining member 30 is formed in an arc shape so that when the hooking segment 331 is forced, the side fringe 131 of the fixing member 10 is guided to slide and retain with the arcuate engagement face 133 as shown in FIGS. 8A-8C, such that when the hooking segment 331 is forced, it slides outward along the arcuate engagement face 133 to disengage from the engaging portions 13 as illustrated in FIG. 11.

A top side of the anchor 22 is a tilted surface to correspond to the shoulder 14 so that when the anchor 22 is forced outward, it moves upward, such that the anchor 22 abuts against the shoulder 14 to generate an outward and upward moving force, hence the anchor 22 slides quickly to disengage from the engaging portion 13 easily.

The first hook 32 of the retaining member 30 also includes a fixing rim 321 to retain with the positioning notch 123 when the first hook 32 inserts to the first chamber 120 of the fixing member 10.

Due to a thickness of the fixing member 10 is thin, the second cave 161 of the external face 16 can not receive a second head end 211 of the first screw bolt 21 completely, a hollow first orifice 34 has to be provided on the retaining member 30 to receive the second head end 211 properly as shown in FIG. 9 to prevent the retaining member 30 from operation.

The retaining member 30 further includes at least two bores 35 and at least two second screw bolts 36; there are three bores 35 and three second screw bolts 36 provided in this embodiment, wherein the body 31 includes three tabs 351 attached on two sides thereof in a triangle arrangement, and each tab 350 includes one bore 35 formed thereon.

The covering member 40 includes a mouth 41, a groove 42, and at least two connecting sections 43 located at the groove 42; there are three triangular columns provided in this embodiment to form the connecting sections 43, and each column includes a second orifice 431 disposed on a distal end thereof so that the retaining member 30 inserts through the bore 35 to screw with the second orifice 431 of the column at the groove 42 of the covering member 40 by ways of the second screw bolts 36, positioning the covering member 40.

After the retaining member 30 is screwed with the covering member 40, it is received in the groove 40 completely so that the covering member 40 retains with the fixing member 10 by means of the retaining member 30, and a side periphery 411 of the mouth 41 of the covering member 40 contacts with the outer face 2*a* of the wall 2 tightly without generating a gap between the covering member 40 and the wall 2.

The shaft 50 is fixed on the covering member 40 to obtain a hanging function.

Thereby, a feature of the wall mounting bath accessory assembly 1 focus on a connecting structure between the fixing member 10 and the retaining member 30, accordingly other retaining methods are applicable for the fixing member 10 as well. For example, a self-tapping screw is capable of being used as the retaining member to position the wall mounting bath accessory assembly 1 on another wall made of a certain material. Likewise, the retaining member 0 is not limited to be applicable for the covering member 40 and the shaft 50 but also suitable for other hanging assemblies.

A difference of a wall mounting bath accessory assembly 1 according to a second embodiment of the present invention from that of the first embodiment contains:

a fixing member 10 including two contacting fences 11, one of which is formed in a circle shape, and another of which is formed in an oval shape, wherein the circular contacting fences 111 include two through holes 15 arranged therein individually; the fixing member 10 also includes an external face 16 having two second caves 161, one of which is formed in a circle shape, and another of which is formed in an oval shape, the second caves 161 include the two through holes 15 arranged therein respectively.

There are two bores 35 and two second screw bolts 36 provided on the retaining member 30 of this embodiment, and the bore 35 is arranged vertically on a body 31 of the retaining member 30. Furthermore, a covering member 40 includes a groove 42, and the groove 42 includes two connecting sections 43 longitudinally arranged therein, wherein the connecting section 43 is comprised of a column with a second orifice 431 so that the second screw bolt 36 inserts through the bore 35 to screw with the second orifice 431 of the covering member 40.

In assembly, the locking device 20 is locked on the outer face 2*a* of the wall 2 by using the anchors 22 and the first screw bolts 21, and then the first screw bolts 21 are used to lock the retaining member 30 in the groove 42 of the covering member 40, thereafter the retaining member 30 is connected with the fixing member 10.

Figure 7B:
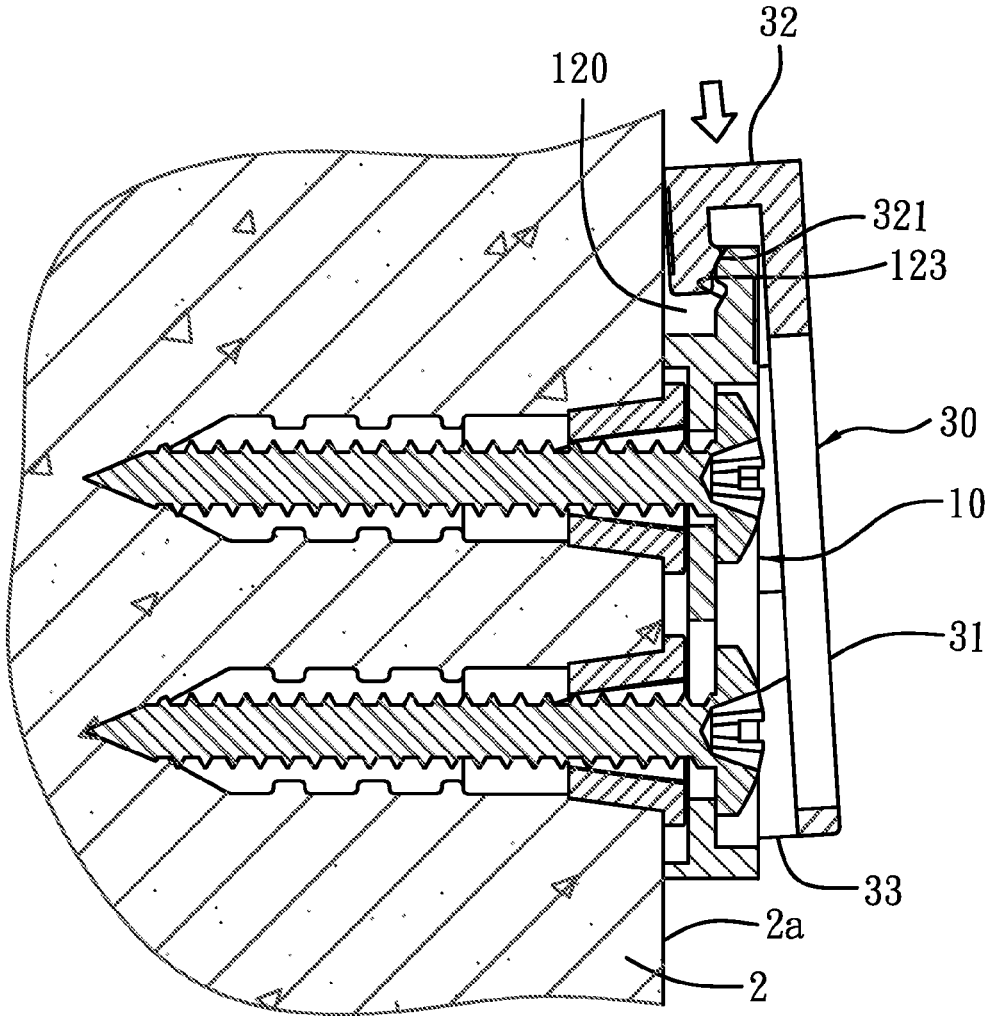
FIG. 7B is another cross sectional view showing the operation of the wall mounting bath accessory assembly in accordance with the first embodiment of the present invention.
Figure 7C:
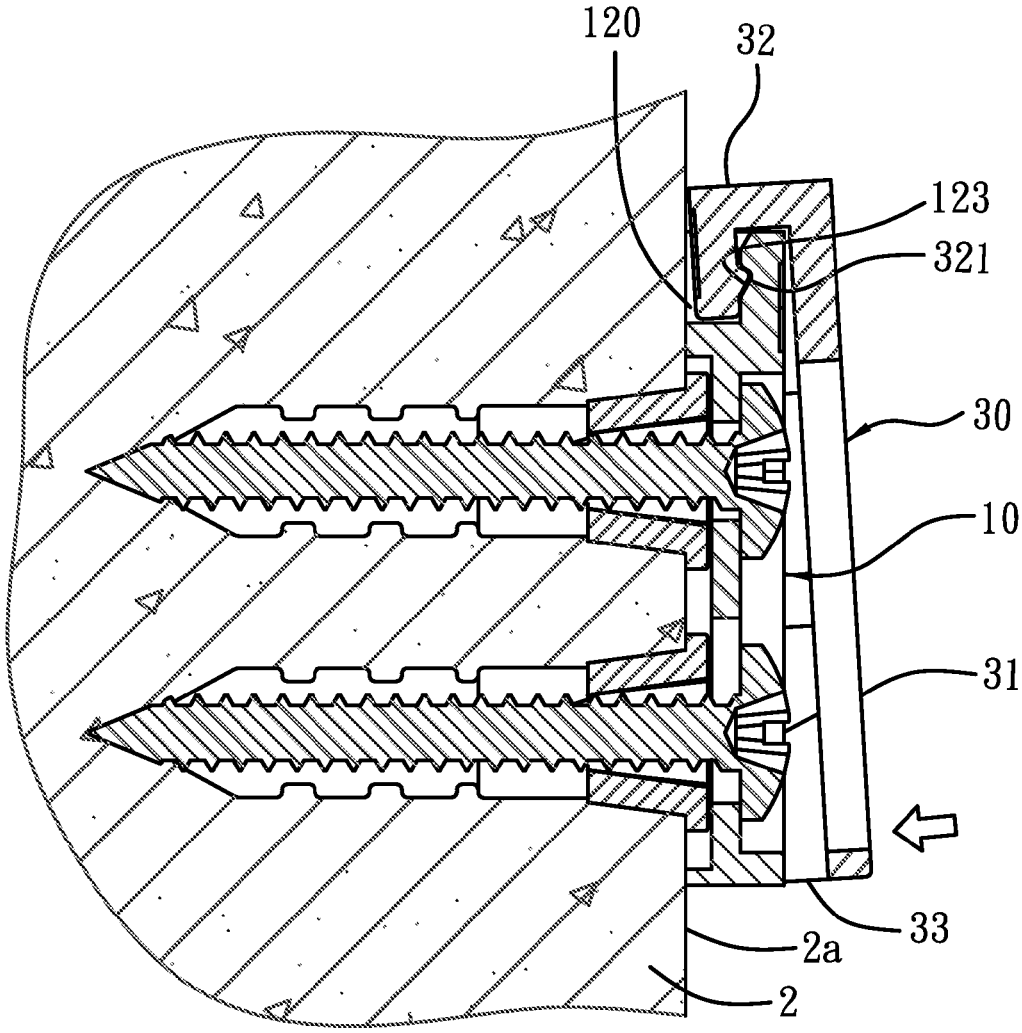
FIG. 7C is also another cross sectional view showing the operation of the wall mounting bath accessory assembly in accordance with the first embodiment of the present invention.
Figure 10:
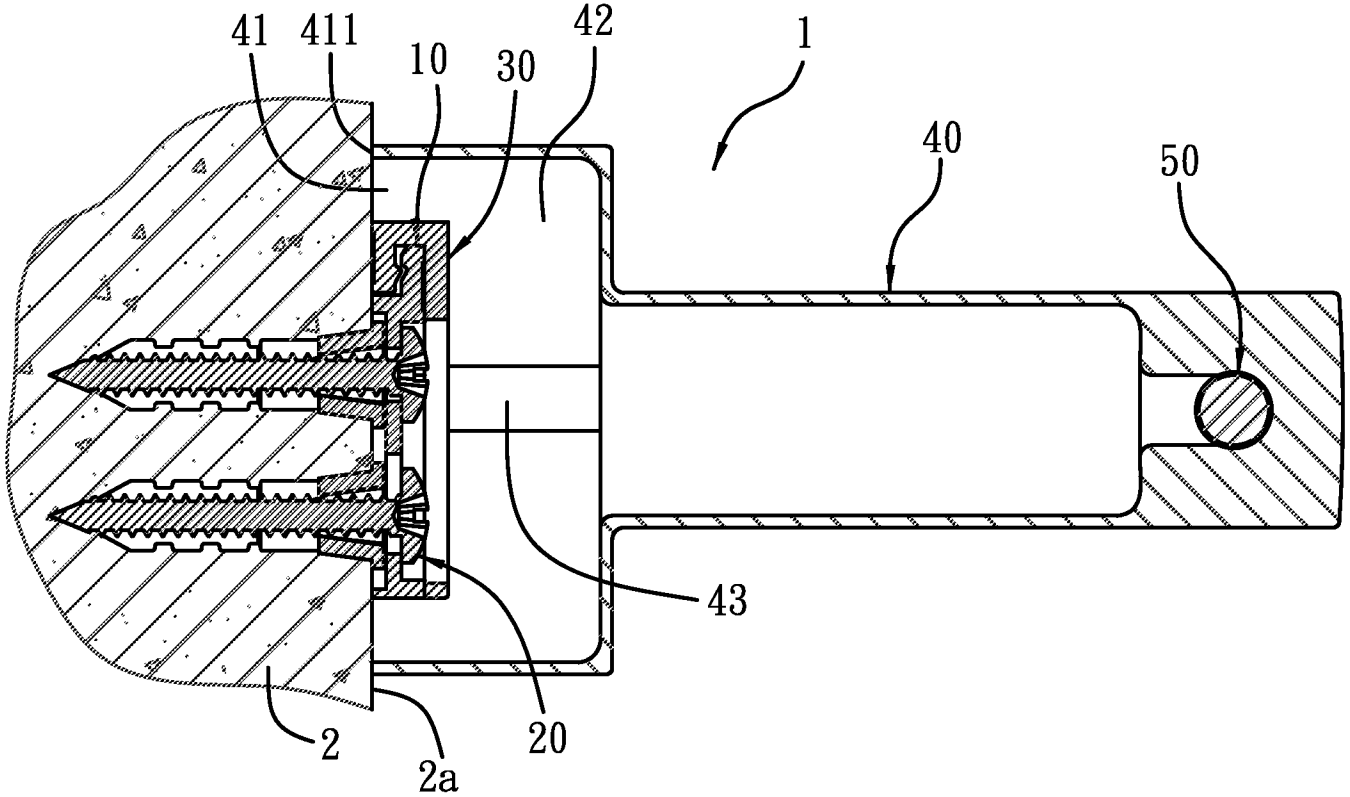
FIG. 10 is another cross sectional view showing the operation of the wall mounting bath accessory assembly in accordance with the first embodiment of the present invention.

In operation, the first hook 32 of the retaining member 30 is inserted to the first chamber 120 from the opening 121 of the fixing member 10 as shown in FIGS. 7A-7B, and then the lower end of the retaining member 30 is pressed inward as illustrated in FIG. 7C so that the second hook 33 retains with the engaging portion 13 of the fixing member 10 as shown in FIGS. 8A-8C, thus assembling the wall mounting bath accessory assembly quickly as illustrated in FIG. 10.

In disassembly, the two second hooks 33 of the retaining member 30 are pushed outward to disengage from the engaging portions 13 of the fixing member 10 as shown in FIG. 11, thereafter the retaining member 30 is pushed upward until the first hook 32 of the retaining member 30 disengages from the first chamber 120 of the fixing member 10 completely, hence the retaining member 30 is disassembled from the covering member 40 and the shaft 50 quickly to facilitate a replacement.

While we have shown and described various embodiments in accordance with the present invention, it is clear to those skilled in the art that further embodiments may be made without departing from the scope of the present invention.

What is claimed is:

1. A wall mounting bath accessory assembly comprising:

a fixing member including a contacting fence disposed on an inner side thereof, the contacting fence including a recess fixed on an upper end thereof, the fixing member including two engaging portions extending from two sides of a lower end thereof respectively, and the engaging portion including a shoulder arranged on an upper end thereof;

a retaining member including a body, an inversely L-shaped first hook extending inward from a top end of the body, and two second hooks extending inward respectively from two sides of a lower end of the body;

the first hooks being inserted through an upper end of the fixing member to retain with the recess so as to limit the retaining member;

each second hook including a hooking segment formed on a distal end thereof to retain with the first hook and the recess, and when a lower end of the retaining member is pushed inward, the engaging portions of the fixing member abutting against the retaining member to cause a resilient deformation so that the retaining member retains with the engaging portions, and a top end of an anchor being stopped by the shoulder so that an upward displacement of the retaining member is limited;

wherein the contacting fence of the fixing member is fixed onto an outer face of a wall, and between the recess of the contacting fence and the outer face of the wall is defined a first chamber, the first chamber includes an opening formed on a top end thereof;

the first hook is inserted into the first chamber through the opening of the fixing member so as to limit the retaining member.

2. The wall mounting bath accessory assembly as claimed in claim 1, wherein the recess of the fixing member includes an elongated positioning notch extending thereon relative to a bottom cliff of the outer face of the wall; the first hook of the retaining member also includes a fixing rim to retain with the positioning notch.

3. The wall mounting bath accessory assembly as claimed in claim 1, wherein the engaging portion extends longitudinally on each of two sides of the lower end of the fixing member, and includes a side fringe, an internal fringe, and an arcuate engagement face between the side fringe and the internal fringe; the each second hook includes a hooking segment formed in an arc shape on a distal end thereof to retain with the first hook and the first chamber so that when the hooking segment is forced, the side fringe of the fixing member is guided to slide and retain with the arcuate engagement face, such that when the hooking segment is forced, it slides outward along the arcuate engagement face to disengage from the engaging portions.

4. The wall mounting bath accessory assembly as claimed in claim 1 further comprising a locking device to position the fixing member onto the outer face of the wall.

5. The wall mounting bath accessory assembly as claimed in claim 4, wherein the locking device includes two first screw bolts and two anchors retained in the wall; the fixing member further includes two through holes formed thereon, and the first screw bolts are inserted through the through holes of the fixing member to screw with the anchors in the wall so that the contacting fence of the fixing member engages with the outer face of the wall tightly.

6. The wall mounting bath accessory assembly as claimed in claim 5, wherein the two through holes are arranged vertically on the fixing member, and one through hole is circular, and the other through hole is elongated and extends vertically on the fixing member.

7. The wall mounting bath accessory assembly as claimed in claim 5, wherein the contacting fence of the fixing member includes at least one first cave disposed thereon to define the through holes, and a size of the first cave is more than that of a first head end of the anchor to receive the first head end.

8. The wall mounting bath accessory assembly as claimed in claim 5, wherein the fixing member further includes an external face having at least one second cave to define the through holes and to receive a second head end of the first screw bolt which inserts through the through hole.

9. The wall mounting bath accessory assembly as claimed in claim 5, wherein a hollow first orifice is provided on the retaining member to receive the second head end of the first screw bolt.

10. The wall mounting bath accessory assembly as claimed in claim 1, further comprises a covering member including a mouth, a groove, and at least two connecting sections located at the groove; the retaining member further includes at least two bores and at least two second screw bolts; the second screw bolt inserts through the bore to screw with the connecting section of the covering member so that the retaining member is positioned in the covering member before retaining with the fixing member.

11. The wall mounting bath accessory assembly as claimed in claim 10, wherein the groove of the covering member includes three triangular columns provided therein to form the connecting sections, and each column includes a second orifice disposed on a distal end thereof; the body of the retaining member includes three tabs attached on two sides thereof in a triangle arrangement, and each tab includes one bore formed thereon so that the second screw bolt of the retaining member inserts through the groove to screw with the second orifice of the column.

12. The wall mounting bath accessory assembly as claimed in claim 10, wherein the groove includes two connecting sections longitudinally arranged therein, and the connecting section is comprised of one column with one second orifice so that the second screw bolt inserts through the bore to screw with the second orifice of the covering member.

13. The wall mounting bath accessory assembly as claimed in claim 10, wherein after the retaining member is fixed in the covering member, it is received in the groove of the covering member.

14. The wall mounting bath accessory assembly as claimed in claim 10, wherein the covering includes a shaft fixed thereon.

* * * * *